US007626335B2

(12) United States Patent
Park et al.

(10) Patent No.: US 7,626,335 B2
(45) Date of Patent: Dec. 1, 2009

(54) PLASMA DISPLAY PANEL(APPARATUS)

(75) Inventors: Chung Hoo Park, Busan-si (KR); Jung Woo Ok, Busani-si (KR); Ho Jun Lee, Busan-si (KR)

(73) Assignee: LG Electronics Inc., Seoul (KR)

( * ) Notice: Subject to any disclaimer, the term of this patent is extended or adjusted under 35 U.S.C. 154(b) by 449 days.

(21) Appl. No.: 11/369,741

(22) Filed: Mar. 8, 2006

(65) Prior Publication Data

US 2007/0120479 A1 May 31, 2007

(30) Foreign Application Priority Data

Nov. 29, 2005 (KR) ..... 10-2005-0114892

(51) Int. Cl.
*H01J 17/49* (2006.01)

(52) U.S. Cl. ..... 313/583; 345/37; 313/586

(58) Field of Classification Search ..... 313/582–587; 345/37, 41, 60, 71

See application file for complete search history.

(56) References Cited

U.S. PATENT DOCUMENTS 5,696,523 A * 12/1997 Yano ..... 345/60
6,276,980 B1 8/2001 Kim
6,517,400 B1 2/2003 Cho et al.
6,624,591 B2 * 9/2003 Mori et al. ..... 315/169.3
2003/0122468 A1 7/2003 Cho et al.
2004/0135507 A1 * 7/2004 Park et al. ..... 313/582
2005/0194901 A1 9/2005 Hong et al.
2005/0285529 A1 * 12/2005 Hwang et al. ..... 313/584
2006/0071595 A1 * 4/2006 Woo et al. ..... 313/584

OTHER PUBLICATIONS

Chinese Office Action dated Dec. 26, 2008.
European Search Report dated May 6, 2009.

* cited by examiner

*Primary Examiner*—Peter J Macchiarolo
*Assistant Examiner*—Donald L Raleigh
(74) *Attorney, Agent, or Firm*—Ked & Associates LLP

(57) ABSTRACT

The plasma display apparatus includes a first electrode and a second electrode formed on an upper substrate, and a barrier rib. The second electrode is arranged in parallel with the first electrode. The barrier rib is formed on a lower substrate opposite to the upper substrate to divide a discharge space. The first electrode and the second electrode are respectively protruded toward the discharge space to have a predetermined thickness. A discharge occurs between the first electrode and the second electrodes opposite to the first electrode. Since the margin of static characteristics increases, the voltage range in which stable driving is possible increase and the amount of the consumption of the discharge current decreases, to thereby reducing power consumption, and enhancing the luminous efficiency and the efficiency of the plasma discharge.

18 Claims, 13 Drawing Sheets

PLASMA DISPLAY PANEL(APPARATUS)

BACKGROUND OF THE INVENTION

1. Field of the Invention

The present invention relates to a plasma display apparatus, and more particularly to a plasma display apparatus in which bus electrodes respectively have a predetermined thickness so as to easily generate a plasma discharge between the bus electrodes opposite to each other, or the bus electrodes respectively protrude toward discharge spaces to form at least two electrode layers.

2. Description of the Background Art

In general, in a plasma display apparatus, a barrier rib formed between an upper glass substrate and a lower glass substrate forms one unit cell. Each cell is filled with an inert gas such as He—Ne or He—Xe. When the inert gas is discharged in response to a high frequency voltage, vacuum ultraviolet rays are generated, and phosphors formed between the barrier ribs are excited to implement images. The plasma display apparatus is widely used as a next generation display device because the plasma display apparatus can be easily manufactured due to the simple structure and has advantages of thinner structure and low power consumption.

FIG. 1 is a cross-sectional view illustrating the structure of a conventional ITO-less plasma display apparatus. FIG. 1 shows a discharge cell of a plasma display apparatus of which upper substrate is rotated by an angle of 90 degree.

In general, since the conventional plasma display apparatus displays images while visible rays generated from the phosphors pass through the upper substrate, a scan electrode and a sustain electrode formed on the upper substrate are formed as a transparent electrode. The transparent electrode has a transparent property so that the visible rays can be transmitted through, and is usually comprised of Indium Tin Oxide (ITO) and tin oxide ($SnO_2$).

However, a bus electrode is used together with the transparent electrode since the transparent electrode has a large resistance.

In this structure, an ITO patterning process is essentially required so as to improve beam permeability, and the ITO patterning process greatly affect the efficiency of the plasma discharge. However, the efficiency and characteristics of the plasma discharge may be deteriorated when the ITO is misaligned and the ITO is cut off. The competitive price of the Plasma Display Panel (PDP) is reduced because labor costs and the cost of materials increase due to the use of the ITO.

Thus, an ITO-less method in which the ITO patterning process is omitted has been developed, and the structure of the ITO-less plasma display apparatus with reference to FIG. 1.

Referring to FIG. 1, a pair of scan electrodes 11 and sustain electrode 12 are formed on an upper glass substrate 10 and an address electrode 21 is formed on a lower glass substrate 20 to cross the scan electrode 11 and the sustain electrode 12.

The scan electrode 11 and the sustain electrode 12 is comprised of a metal electrode i.e. a bus electrode.

An upper dielectric layer 13 is formed on the upper substrate 10 on which the scan electrode 11 and the sustain electrode 12 are formed, to cover the scan electrode 11 and the sustain electrode 12. A protection layer 14 is formed on the upper dielectric layer 13 so as to prevent the upper dielectric layer 13 the scan electrode 11 and the sustain electrode 12 from being damaged by sputtering generated during the discharge of plasma. Magnesium oxide (MgO) is generally used as the protection layer 14.

A lower dielectric layer 23 is formed on the lower substrate 20 to cover the address electrode 21 and a barrier rib 22 is formed on the lower dielectric layer 23. Discharge cells are divided each other by the barrier rib 22. An Red (R), Green (G) and Blue (B) phosphors 24 is coated on the discharge cell.

In the conventional ITO-less plasma display apparatus, a discharge voltage has to increase since a discharge gap between the bus electrodes increases due to the non-existence of the ITO electrode. In this case, the efficiency of the plasma discharge is reduced according as the discharge voltage increases.

In order to solve above problem, there has been developed a technique for increasing the efficiency of the plasma discharge by reducing the discharge gap between the bus electrodes. FIG. 2 shows an example of the structure of electrodes in a conventional ITO-less plasma display apparatus. Referring to FIG. 2, a plurality of bus electrodes is formed in parallel each other in a horizontal direction on each of the scan electrodes 11 and the sustain electrodes 12 so as to increase the efficiency of the plasma discharge. However, an aperture ratio decreases since the bus electrodes are arranged in the horizontal direction. Thus, the beam permeability of the visible rays generated from the phosphors is reduced, and luminance of the plasma display apparatus decreases. The efficiency of the plasma discharge is low since the discharge between the bus electrodes is a surface discharge through the upper dielectric layer 13 of FIG. 1 that covers the bus electrodes.

SUMMARY OF THE INVENTION

Accordingly, an object of the present invention is to solve at least the problems and disadvantages of the background art.

It is a feature of the present invention to provide a plasma display apparatus having a bus electrode structure in which bus electrodes respectively have a predetermined thickness and protrude toward discharge spaces so as to easily generate a plasma discharge between the bus electrodes opposite to each other, thereby enhancing the plasma discharge.

A plasma display apparatus according to a first embodiment of the present invention include a first main electrode and a second main electrode formed on an upper substrate, a first sub electrode, a second sub electrode, a third electrode and a barrier rib. The second main electrode is arranged in parallel with the first main electrode. The first sub electrode is protruded from the first main electrode in a first direction toward the second main electrode. The second sub electrode is protruded from the second main electrode in a second direction toward the first main electrode. The third electrode is formed on a lower substrate opposite to the upper substrate. The barrier rib is formed on the lower substrate to divide a discharge space. The first main electrode and the first sub electrode, and the second main electrode and the second sub electrode are respectively laminated toward the lower substrate to respectively form at least two electrode layers.

A plasma display apparatus according to a second embodiment of the present invention includes a first electrode and a second electrode formed on an upper substrate, a third electrode and a barrier rib. The second electrode is arranged in parallel with the first electrode. The third electrode is formed on a lower substrate opposite to the upper substrate. The barrier rib is formed on the lower substrate to divide a discharge space. The first electrode and the second electrode are respectively laminated toward the lower substrate to respectively form at least two electrode layers.

A plasma display apparatus according to a third embodiment of the present invention includes a first electrode and a second electrode formed on an upper substrate, and a dielectric layer. The second electrode is arranged in parallel with the first electrode. The dielectric layer has a predetermined thickness, and the dielectric layer covers the first and second electrode layers. Each of the first and second electrodes is formed toward a lower substrate opposite to the upper substrate to have a thickness of about 50 μm.

In the plasma display apparatus according to the example embodiments of the present invention, a discharge occurs between the first electrode and the second electrodes opposite to the first electrode. Since the margin of static characteristics increases, the voltage range in which stable driving is possible increase and the amount of the consumption of the discharge current decreases, to thereby reducing power consumption, and enhancing the luminous efficiency and the efficiency of the plasma discharge.

BRIEF DESCRIPTION OF THE DRAWINGS

The invention will be described in detail with reference to the following drawings in which like numerals refer to like elements.

DETAILED DESCRIPTION OF EXAMPLE EMBODIMENTS

Example embodiments of the present invention will be described in a more detailed manner with reference to the drawings.

A plasma display apparatus according to example embodiments of the present invention includes a first electrode and a second electrode formed in parallel each other on an upper substrate, and the first and second electrodes protrude toward discharge spaces to have a predetermined thickness.

The first and second electrodes do not include a transparent electrode (i.e. an ITO electrode) and include only a metal electrode, i.e. a bus electrode (ITO-less). The first and second electrodes respectively may include a main electrode and a sub electrode, or alternatively may include only the main electrode without the sub electrode. The sub electrode is protruded from a first main electrode in a direction toward a second main electrode opposite to the first main electrode so that the sub electrode reduces the discharge gap and reduces the discharge voltage.

Figure 1:
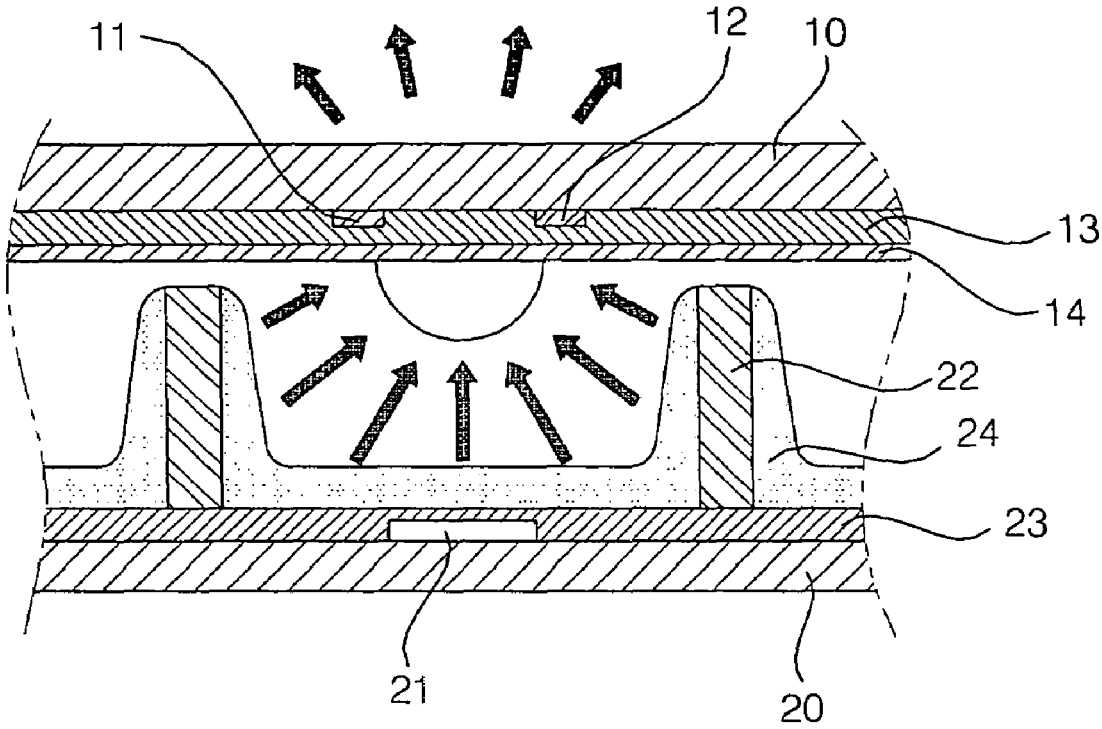
Fig.1 (related art)
FIG. 1 is a cross-sectional view illustrating the structure of a conventional ITO-less plasma display apparatus.
Figure 2:
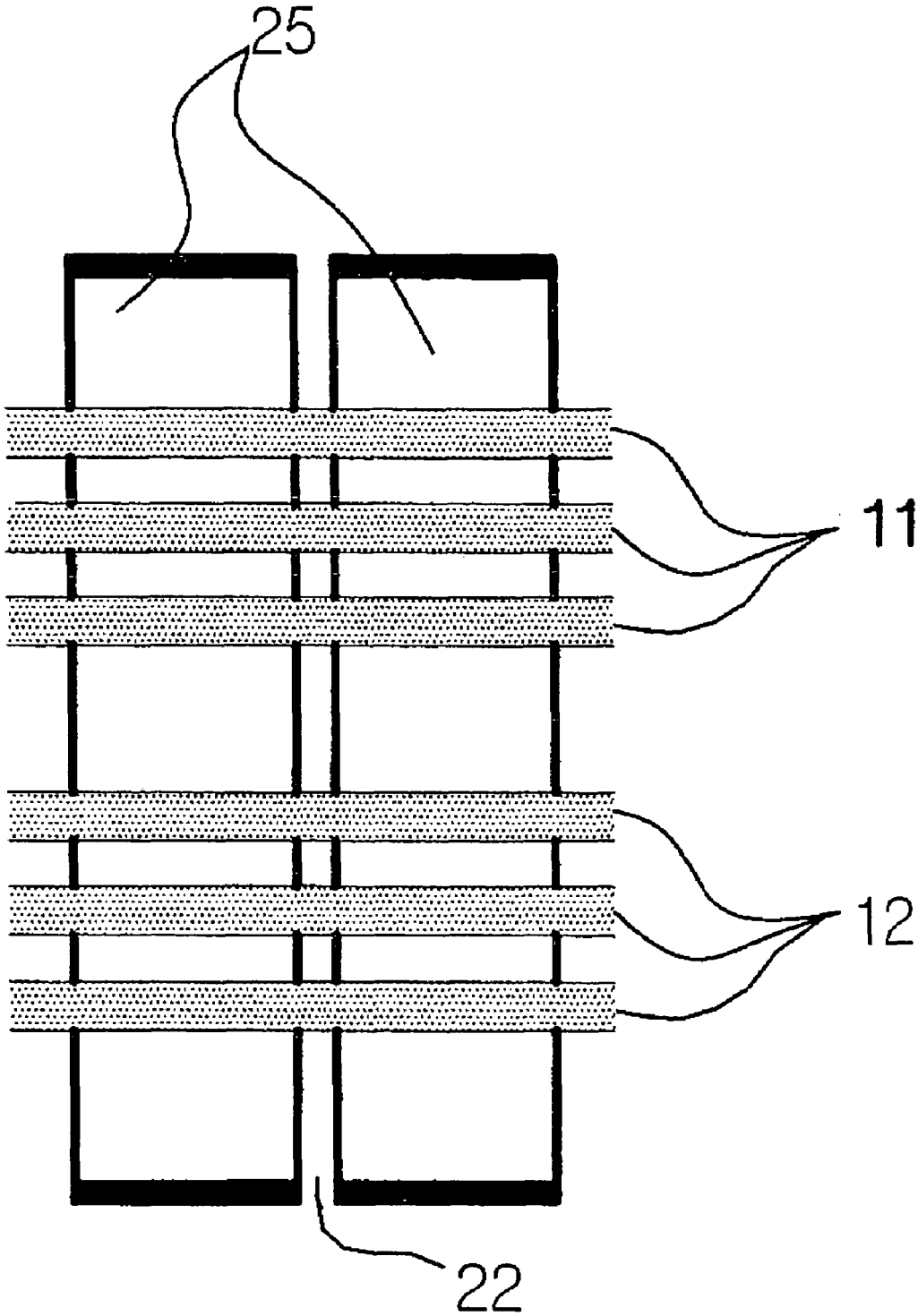
Fig.2 (related art)
FIG. 2 is view illustrating the structure of electrodes in a conventional ITO-less plasma display apparatus.
Figure 3:
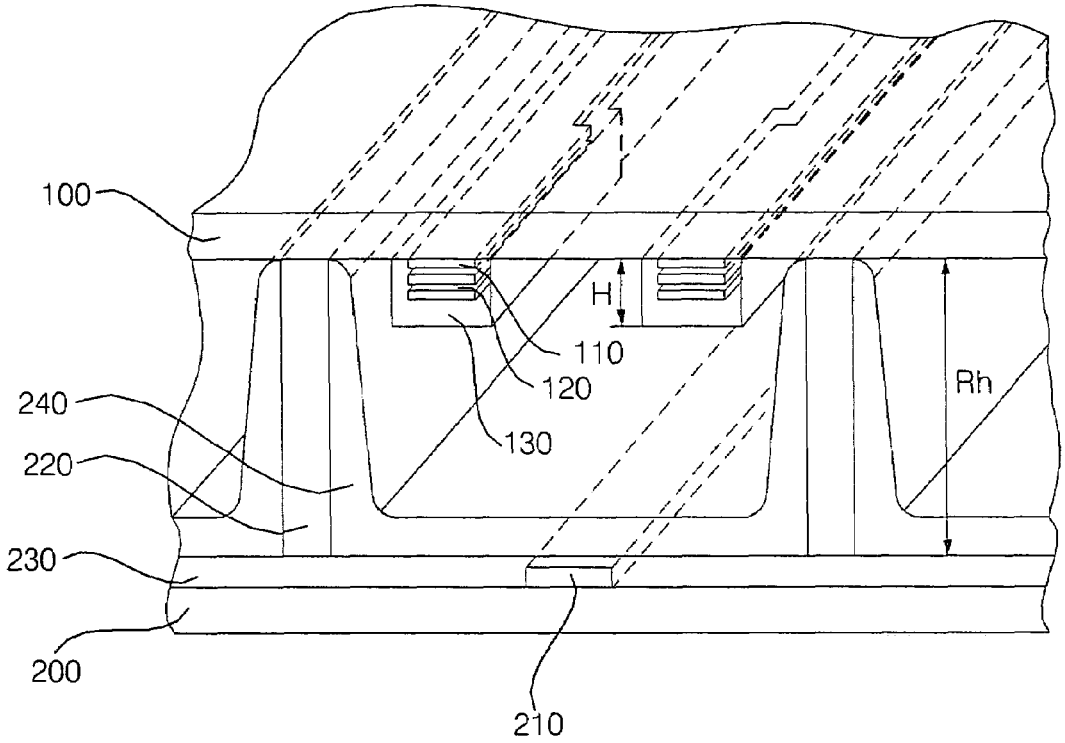
FIG. 3 is a view illustrating a structure of a plasma display apparatus, in which an upper substrate is rotated by 90 degree, according to a first example embodiment of the present invention.
Figure 4:
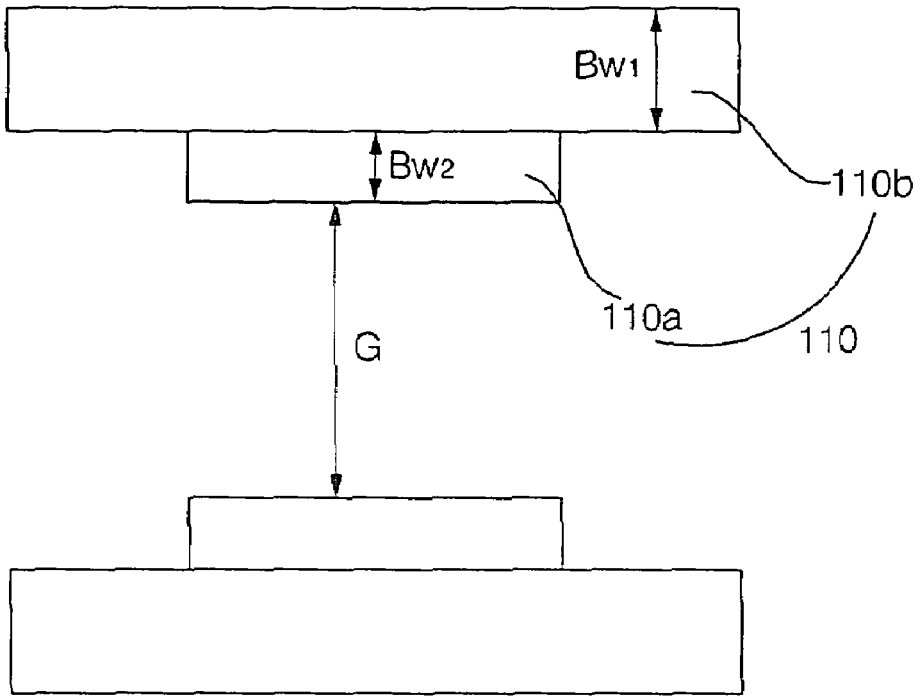
FIG. 4 is a plan view illustrating electrodes of the plasma display apparatus of FIG. 3.

FIG. 3 is a view illustrating a structure of a plasma display apparatus according to a first example embodiment of the present invention. FIG. 3 is a cross-sectional view showing a unit discharge cell of the plasma display apparatus in which an upper substrate is rotated by 90 degree. FIG. 4 is a plan view illustrating electrodes of the plasma display apparatus of FIG. 3, and FIG. 5 is a view illustrating only the electrodes of the plasma display apparatus of FIG. 3.

The plasma display apparatus according to an example embodiment of the present invention includes two electrodes, each formed from a plurality of electrode layers. Each electrode layer of the first electrode includes a first main electrode 110*b* and a first sub electrode 110*a*, and each electrode layer of the second electrode includes a second main electrode and a second sub electrode. The first main electrode 110*b* and the second main electrode in each of the electrode layers are formed on an upper substrate 100 to be arranged in parallel each other. Also, the first sub electrode 110*a* in each layer of the first electrode protrudes from a corresponding first main electrode 110*b* in a direction toward the second main electrode. And the second sub electrode in each electrode layer of the second electrode protrudes from a corresponding second main electrode in a direction towards the first electrode. The first main electrodes and the first sub electrodes in the electrode layers of the first electrode are laminated together in a direction towards the lower substrate 200 to form at least two electrode layers of the second electrode are laminated together in a direction towards the lower substrate 200.

Figure 5:
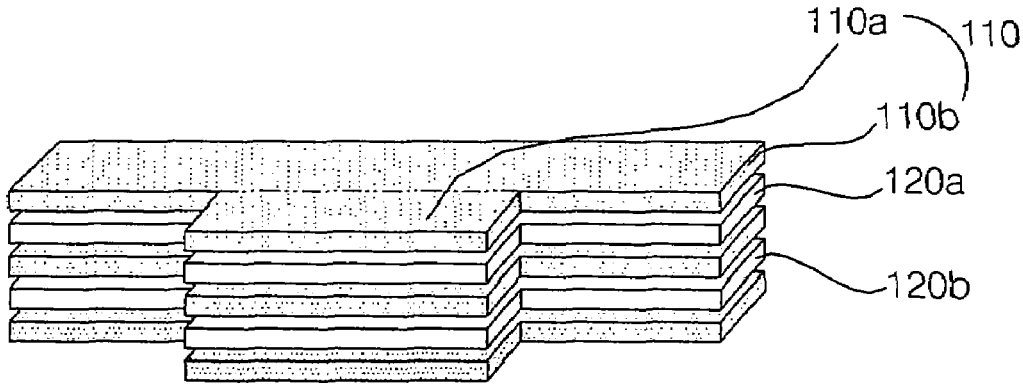
FIG. 5 is a view illustrating only the electrodes of the plasma display apparatus of FIG. 3.

Referring to FIGS. 3 through 5, the first electrode 110 and the second electrode are formed on the upper substrate 100. A third electrode 210 is formed on the lower substrate 200 to cross the first and the second electrodes. A lower dielectric layer 230 is formed on the lower substrate 200 on which the third electrode 210 is formed, and covers the third electrode 210.

Barrier ribs 220 are formed on the lower dielectric layer 230 to divide the discharge cells, and a phosphor 240 is coated inside the discharge cells.

The first main electrode 110*b* and the first sub electrode 110*a* function as a scan electrode, the second main electrode and the second sub electrode function as a sustain electrode, and are symmetrically formed each other. Hereinafter, one of the first electrode and the second electrode will be explained as a reference, however substantially the same explanation will be applied to the other one of the first electrode and the second electrode.

The main electrode 110*b* and the sub electrode 110*a* are comprised of a metal electrode, and may be comprised of the same metal, or alternatively different kind of metal each other.

The metal electrode may be one of Ag, Cr, Cu and Al, etc. The metal electrode may be formed using a photo etching process or alternatively a photosensitive paste process, etc.

The main electrode 110*b* is continuously formed on the upper substrate so that the main electrode 110*b* commonly corresponds to the discharge cells arranged in a row direction.

A width Bw1 of the main electrode 110*b* is about 70 μm. When the width Bw1 of the main electrode 110*b* is less than 70 μm, an electrical open status may be generated while the main electrode is formed, a luminance may be decreased because an amount of current flowing through the main electrode 110*b* decreases since a resistance of the main electrode 110*b* decreases due to a decrease of a cross sectional area of the main electrode 110*b*.

A maximum width of the main electrode 110*b* may vary depending upon the size of the discharge gap. The maximum width of the main electrode 110*b* may be about 150 μm. When the maximum width of the main electrode 110*b* is larger than 150 μm, the main electrode 110*b* may screen (or shield) an upper portion of the discharge cell and may screen (or block out) the visible ray generated from the phosphor, to thereby reducing the luminance.

The sub electrode 110*a* is formed in each of the discharge cells to be protruded from a first main electrode toward a second main electrode opposite to the first main electrode.

A width Bw2 of the sub electrode 110*a* is about 30 μm. The sub electrode 110*a* reduces the discharge gap between the main electrodes opposite to each other. The width Bw2 of the sub electrode 110*a* may be increased up to 150 μm depending upon the size of the discharge gap G and the size of the discharge cell that varies according to the resolution of the plasma display apparatus. The discharge voltage decreases according as the width Bw2 of the sub electrode 110*a* increases, however, the area that screens (or blocks out) the visible ray increases due to the increase of the area of the sub electrode, and thus the luminance may decrease and the efficiency of the plasma discharge may be reduced.

The main electrodes and the sub electrodes are laminated to respectively form at least two electrode layers in each of the first electrode and the second electrode, and the total thicknesses of the first electrode and the second electrode have predetermined values which may be the same.

The electrode layers of each of the first and second electrodes are laminated toward the lower substrate. Namely, the main electrodes and the sub electrodes in the electrode layers of each of the first and second electrodes have an electrode structure in which the main electrodes and the sub electrodes are laminated in a direction that protrudes toward the lower substrate and discharge space.

The plasma display apparatus further includes a first dielectric layer formed between each of the at least two electrode layers.

FIG. 5 shows that main electrodes and the sub electrode in the electrode layers are respectively laminated to respectively form three electrode layers and the first dielectric layer 120*a* or 120*b* is formed between each of the three electrode layers.

A parasitic capacitance of the plasma display panel may be reduced because the electrode layer and the dielectric layer is alternatively laminated each other, a plasma loss may be reduced because the plasma display apparatus has a discharge path longer than a discharge path of a surface discharge, a current consumption may be reduced due to high excitation efficiency of charges.

In addition, the dielectric constants of the first dielectric layers interposed between the electrode layers may be different from each other depending upon the characteristics of the plasma display panel.

The plasma display apparatus further includes a plurality of second dielectric layers respectively having a predetermined thickness, and each of the second dielectric layers covers the at least two electrode layers respectively comprised of the main electrode and the sub electrode.

The second dielectric layer 130 is formed to cover a lower side of the electrode layers and a bottom surface of the lowest electrode layer. The second dielectric layer 130 may be thicker than the first dielectric layer 120, and thus a parasitic capacitance may be reduced.

Figure 6:
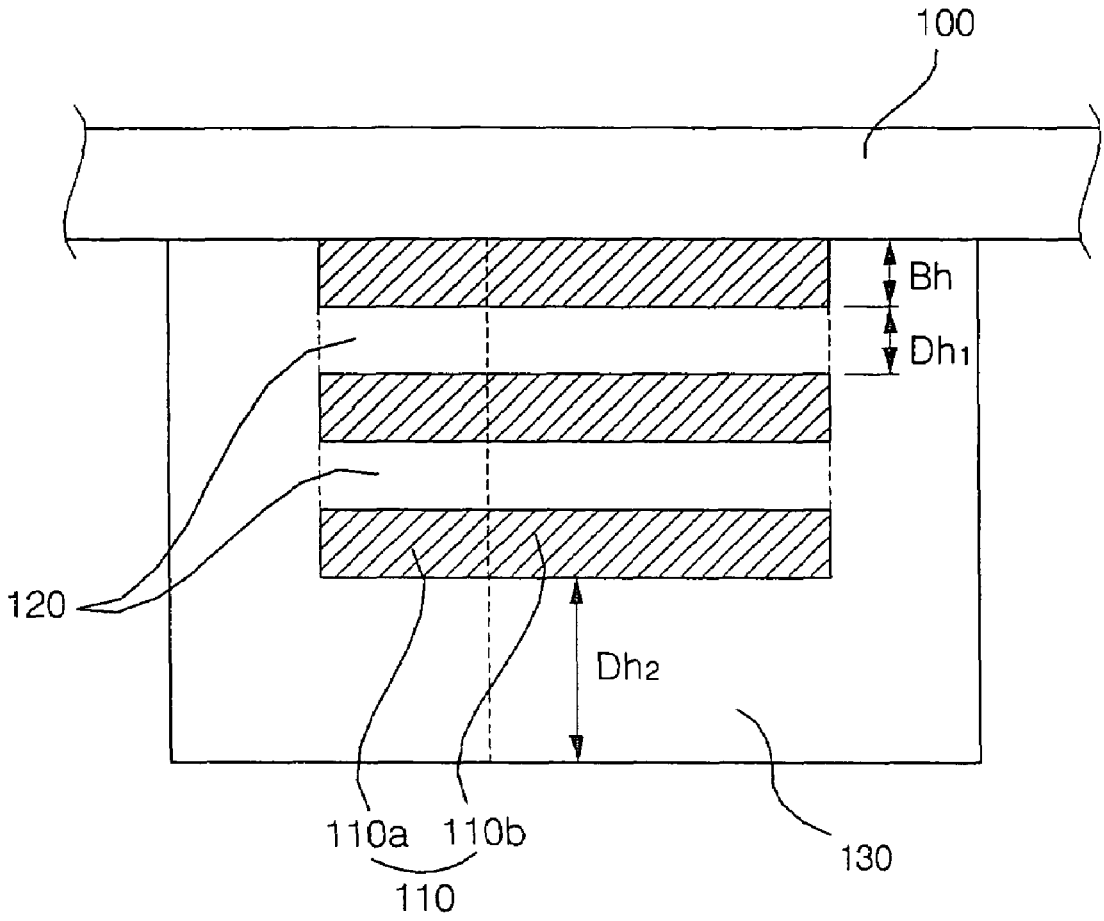
FIG. 6 is a cross-sectional view illustrating the electrodes of the plasma display apparatus of FIG. 3.

FIG. 6 is a cross-sectional view illustrating the electrodes of the plasma display apparatus of FIG. 3. FIG. 3 shows thicknesses of the three electrode layers 110 formed on the upper glass substrate 100, the first dielectric layer 110 and the second dielectric layer 130.

The thickness Bh of the main electrode or the sub electrode is about 10 μm, and the thickness Dh1 of the first dielectric layer may be substantially the same as that of the main electrode or the sub electrode.

In the embodiment of the present invention where a total thickness of a plurality of electrode layers have a predetermined value, the electrically open status may occur or the luminance may decrease due to the increase of the resistance of the electrode layer when the thickness Bh of an electrode layer is less than about 10 μm.

When the thickness of one electrode layer and the first dielectric layer is more than about 10 μm, the total thickness (H in FIG. 3, Bh×3+Dh1×2+Dh2 in FIG. 6) of the electrode layers. Thus, the usability of the phosphors disposed at left barrier rib and right barrier rib may be reduced because the distance between the electrode layers and the lower substrate, the luminance may be decreased because the visible rays generated from the left barrier rib and the right barrier rib are shielded (or cut off) by the projected electrode (i.e. the sub electrode).

Thus, the thickness of each of the electrode layers, the thickness of the first dielectric layer and the thickness of the second dielectric layer may be determined based on the total thickness (H in FIG. 3, Bh×3+Dh1×2+Dh2 in FIG. 6) of the electrode layers, a distance (or a height of the barrier rib Rh of FIG. 3) between the upper substrate and the lower substrate. For example, the total thickness H of the electrode layers may be less than a half of the height Rh of the barrier rib.

Figure 7:
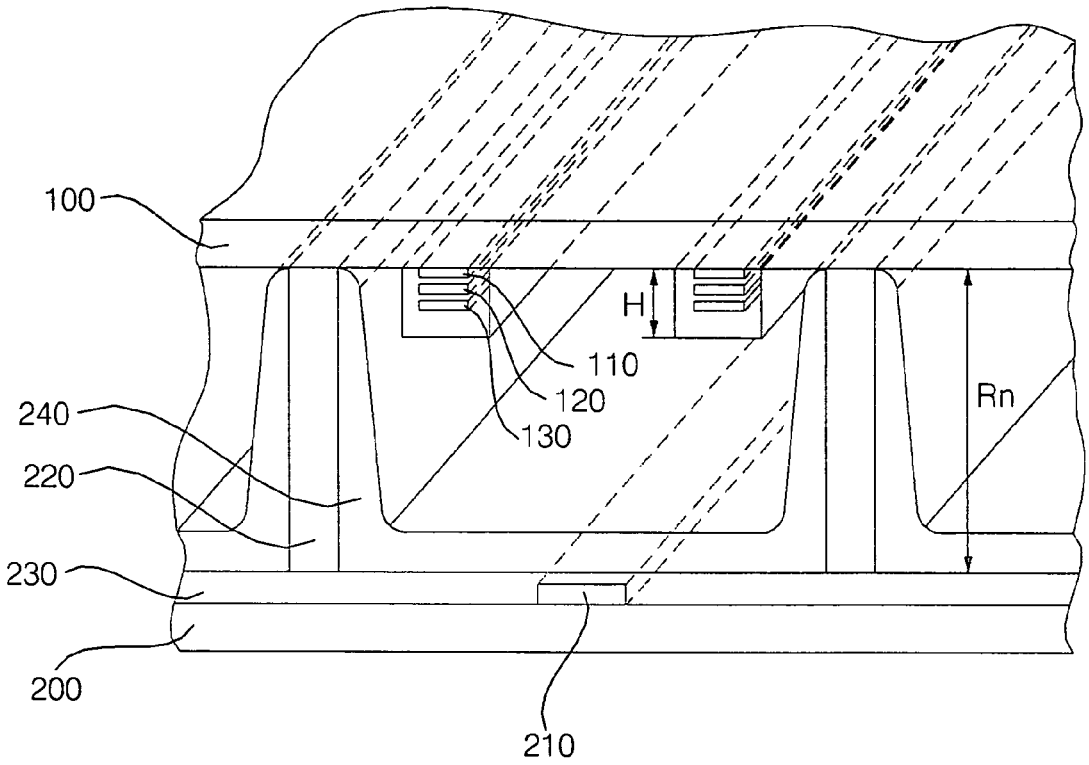
FIG. 7 is a view illustrating a structure of a plasma display apparatus according to a second example embodiment of the present invention.

FIG. 7 is a view illustrating a structure of a plasma display apparatus according to a second example embodiment of the present invention.

Referring to FIG. 7, a basic structure of the plasma display apparatus according to the second example embodiment of the present invention is the same as that of the plasma display apparatus according to the first example embodiment of the present invention, however differs from the plasma display apparatus according to the first example embodiment of the present invention in that only the main electrode is formed and the sub electrode is not formed.

Particularly, the first electrode and the second electrode are formed in parallel each other on the upper substrate. The first and the second electrode respectively are laminated to respectively form at least two electrode layers, and respectively are protruded toward the discharge space.

In the second example embodiment of the present invention, the aperture ratio may be enhanced and the luminance may be increased due to the non-existence of the sub electrode. However, the driving voltage needs to be increased because the distance between the first and second electrodes increases, the efficiency of the plasma discharge may be enhanced compared with the conventional plasma display apparatus.

In addition, the discharge gap between the first and second electrodes of the plasma display apparatus according to the second example embodiment of the present invention may be narrower than the discharge gap between the first and second electrodes of the plasma display apparatus according to the first example embodiment of the present invention.

Figure 8:
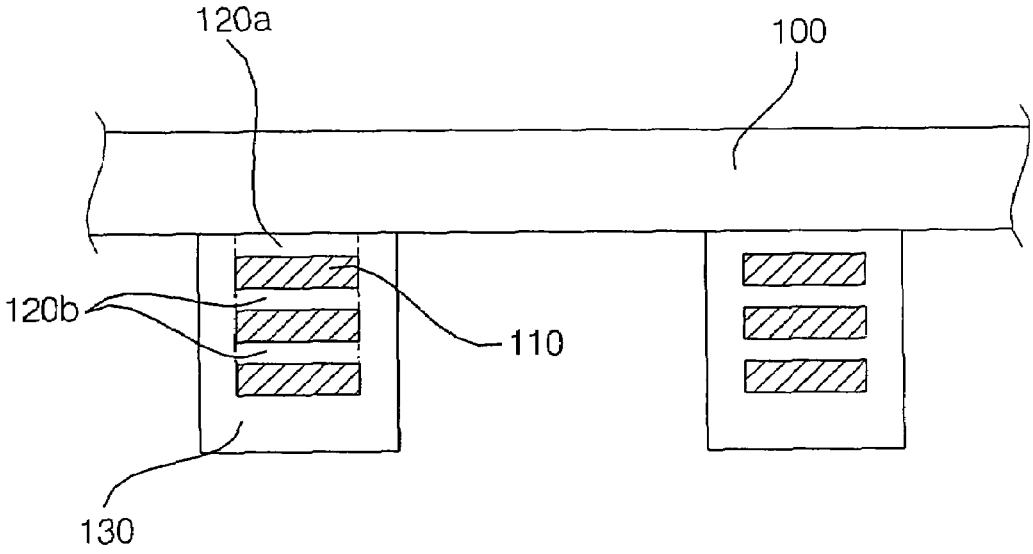
FIG. 8 is a view illustrating a structure of a plasma display apparatus according to a third example embodiment of the present invention.

FIG. 8 is a view illustrating a structure of a plasma display apparatus according to a third example embodiment of the present invention. The plasma display apparatus according to the third example embodiment of the present invention has a structure, in which each electrode includes a at least two metal electrode layers laminated together in a direction protruded toward the discharge space, which is the same as the structure of the plasma display apparatus according to the first and the second example embodiments of the present invention. However, the third example embodiment differs from the plasma display apparatus according to the first and the second example embodiments of the present invention in that a third dielectric layer 120*a* is formed between the upper substrate 100 and a top electrode layer 110 of the at least two electrode layers.

In the third example embodiment of the present invention, the plasma display apparatus may have a T-shape of electrode structure in which both the main electrode and the sub electrode are formed, however, may have an I-shape of electrode structure in which only the main electrode without the sub electrode are formed.

A first dielectric layer 120*b* is formed between each of the metal electrodes, and a third dielectric layer 120*a* is formed between the upper substrate 100 and the top electrode layer 110 of the at least two metal electrode layers. Thus, a parasitic capacitance of the plasma display panel may be reduced, and a total thickness of the laminated electrode layers may decrease by the third dielectric layer, and the plasma discharge may occur between the first electrode and the second electrode opposite to the first electrode.

A second dielectric layer is formed to cover the first dielectric layer 120*b* and the third dielectric layer 120*a*.

Dielectric constants of the first, second and third dielectric layers may be different from each other or alternatively may have the same value each other.

Thus, the thickness of each of the electrode layers, the thickness of the first dielectric layer, the thickness of the second dielectric layer and the thickness of the third dielectric layer may be determined based on the total thickness of the electrode layers, a distance between the upper substrate and the lower substrate according to the number of the electrode layers and the number of the dielectric layers. For example, the total thickness H of the electrode layers may be less than about a half of the height Rh of the barrier rib.

Figure 9:
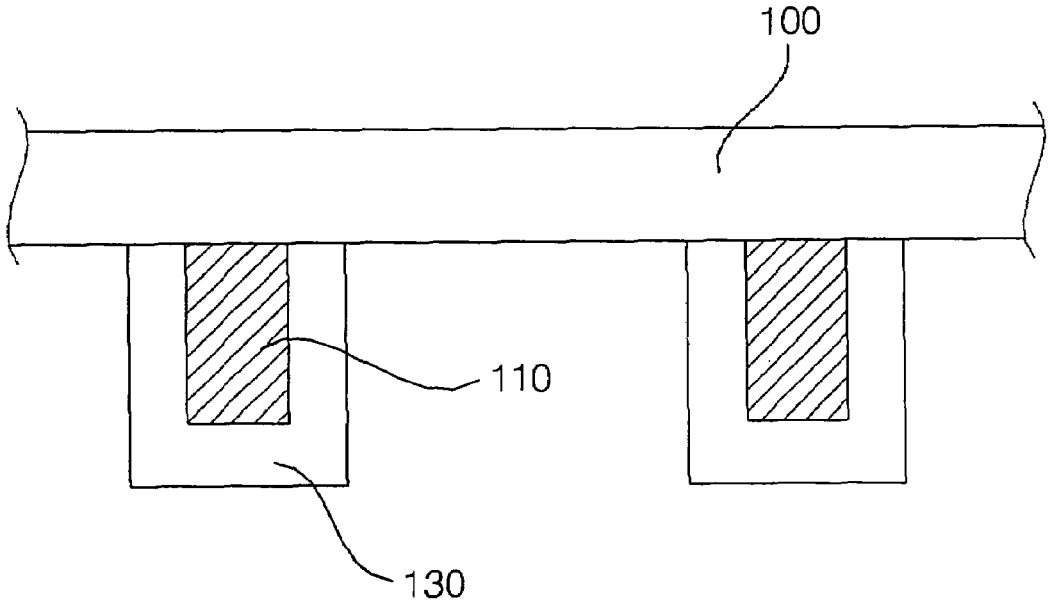
FIG. 9 is a view illustrating a structure of a plasma display apparatus according to a fourth example embodiment of the present invention.

FIG. 9 is a view illustrating a structure of a plasma display apparatus according to a fourth example embodiment of the present invention. Referring to FIG. 9, the plasma display apparatus according to the fourth example embodiment of the present invention includes a first electrode 110, a second electrode, and a dielectric layer 130. The first electrode 110 and the second electrode respectively are formed on an upper substrate 100 to have a predetermined thickness. The dielectric layer 130 covers the first electrode 110 and the second electrode. The first electrode 110 and the second electrode are protruded toward a discharge space.

The first electrode 110 and the second electrode are comprised of metal electrode, and are comprised of the same material as that of the first electrode and the second electrode of the plasma display apparatus of the first example embodiment of the present invention. The first electrode 110 or the second electrode is not laminated so as to form at least two electrode layers, however, is formed to have a predetermined thickness. Thus, electrical resistance of the first and the second electrodes may be reduced due to increased cross-sectional area of the metal electrode.

The metal electrode may be produced by continuously laminating a plurality of thin metal electrodes so that each of the thin metal electrodes is not spaced apart from each other and a total thickness of the thin metal electrodes has a predetermined value, namely, a dielectric layer is not formed between each of the thin metal electrodes.

In addition, in the fourth example embodiment of the present invention, the plasma display apparatus may have a T-shape of electrode structure in which both the main electrode and the sub electrode are formed, however, may have an I-shape of electrode structure in which only the main electrode without the sub electrode are formed.

Figure 10:
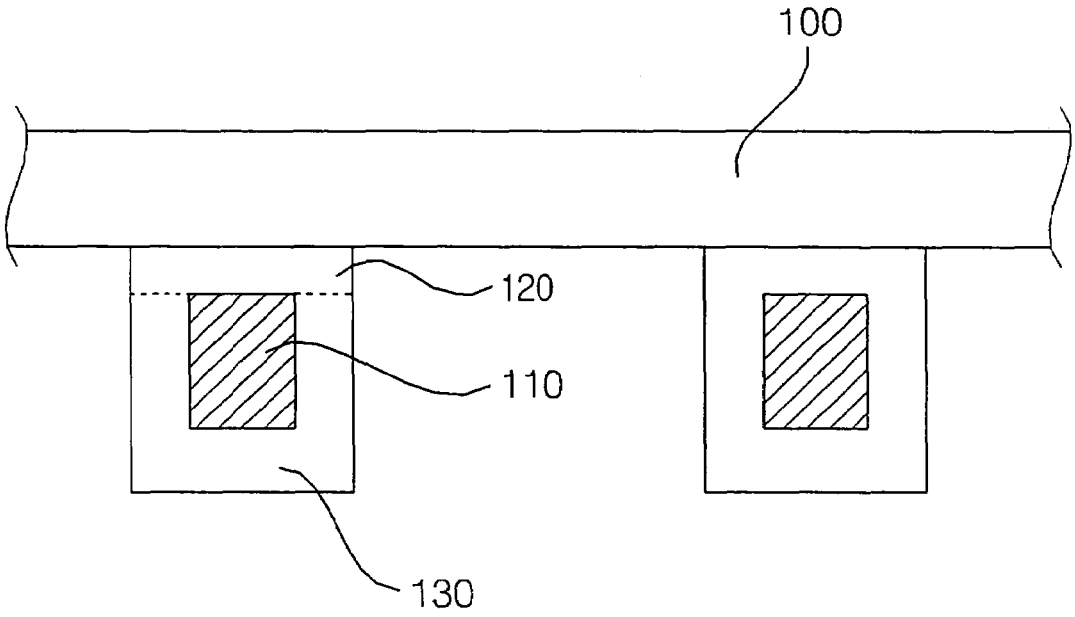
FIG. 10 is a view illustrating a structure of a plasma display apparatus according to a fifth example embodiment of the present invention.

FIG. 10 is a view illustrating a structure of a plasma display apparatus according to a fifth example embodiment of the present invention. Referring to FIG. 10, the plasma display apparatus according to the fifth example embodiment of the present invention includes a first dielectric layer 120, a first electrode 110, a second electrode, and a third dielectric layer 130. The first dielectric layer 120 is formed on the upper glass substrate 100 to have a predetermined thickness, and the first electrode 110 and the second electrode respectively is formed on the upper substrate 100 on which the first dielectric layer 120 is formed to have a predetermined thickness. The third dielectric layer 130 covers the first electrode 110 and the second electrode. The first electrode 110 and the second electrode are protruded toward a discharge space.

In the fifth example embodiment of the present invention, the basic structure and functions of the plasma display apparatus is similar to those of the plasma display device according to the fourth example embodiment of the present invention, however, the first dielectric layer 120 is formed between the upper substrate 100 and the metal electrode 110.

The material of the metal electrode 110 and the dielectric constants of the first and the second dielectric layers 120 and 130 are substantially the same as those of the metal electrode, and the first and the second dielectric layers of the plasma display apparatus of the first example embodiment of the present invention.

The dielectric constants of the first and the second dielectric layers 120 and 130 may vary depending upon the characteristics of the display panel. The thickness of the second dielectric layer may be thicker than that of the first dielectric layer.

The total thickness H of the metal electrode layers and the dielectric layer may be less than about a half of the height Rh of the barrier rib.

Hereinafter, the operation of the plasma display apparatus according to the example embodiments of the present invention will be explained.

Figure 11:
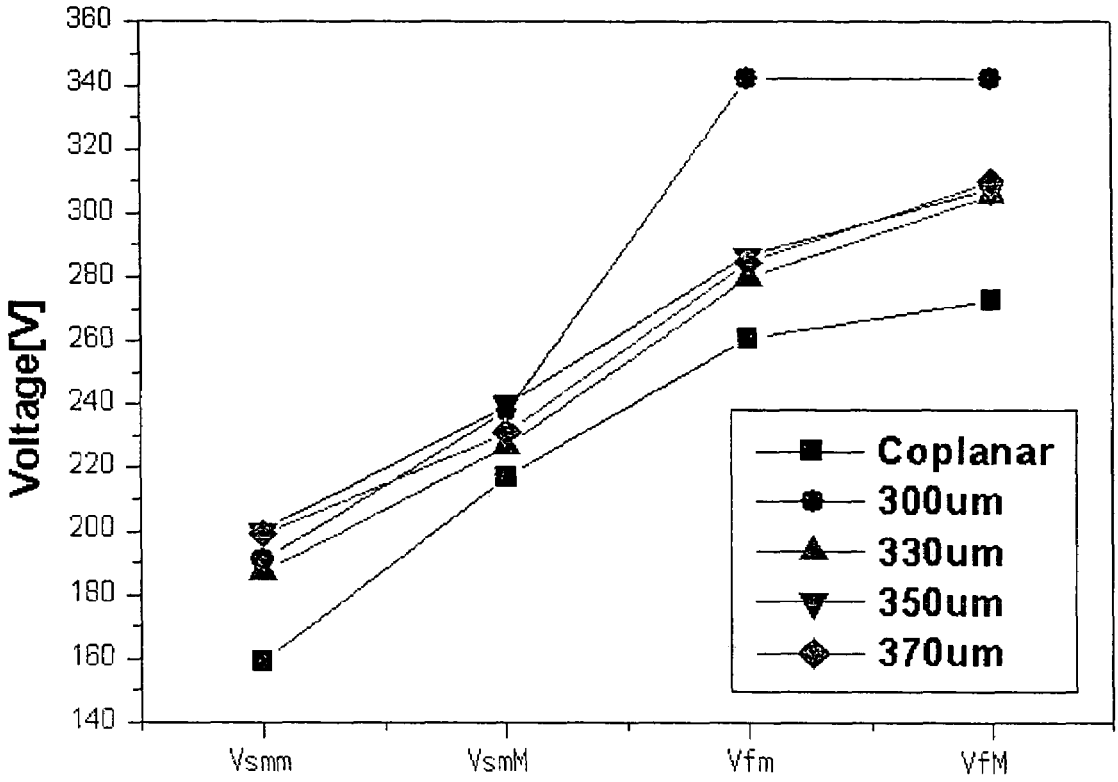
FIG. 11 is a graph illustrating static characteristics of the plasma display apparatus according to an example embodiment of the present invention.

FIG. 11 is a graph illustrating static characteristics of the plasma display apparatus according to an example embodiment of the present invention. FIG. 11 shows On/OFF characteristics of the discharge cells depending upon a driving voltage and a discharge gap, and static margin.

The plasma display apparatus used in the experiment of FIG. 11 has a multi-layer electrode structure that is the same as the electrode structures of the plasma display apparatuses of FIG. 3 and FIG. 7, for example, has three electrode layers. A basic specification is shown in table 1.

TABLE 1

| Discharge gas: Xe(8%) + Ne base, 400 Torr | | |
|---|---|---|
| Upper substrate | Width of each of bus electrodes | 100 μm |
| | Thickness of each of bus electrodes | 10 μm |
| | Thickness of each of first dielectric layers | 10 μm |
| | Thickness of second dielectric layer | 30 μm |
| | Total thickness of electrode layers | 80 μm |
| Lower substrate | Width of address electrode | 100 μm |
| | Thickness of lower dielectric layer | 20 μm |
| | Width of barrier rib | 60 μm |
| | Height of barrier rib | 160 μm |

Here, the width of the bus electrode corresponds to a sum of the width of the main electrode and the width of the sub electrode in the T-shape of multi-layer electrode structure.

The static characteristics are characteristics of ignition and erasure when the driving voltage, i.e. a sustain voltage Vs gradually increases or decreases while a writing pulse and an erasing pulse are not applied to the plasma display apparatus.

An initiation voltage represents Vf, and an erasure voltage represents a minimum (discharge) sustain voltage in one discharge cell.

Vf is a voltage in an instance when an OFF status is changed to an ON status. Vsm is a voltage in an instance when an ON status is changed to an OFF status.

Vf and Vsm may be divided into four types as shown below since cell characteristics of each of discharge cells in a plasma display apparatus having N discharge cells are different from each other.

Figure 12:
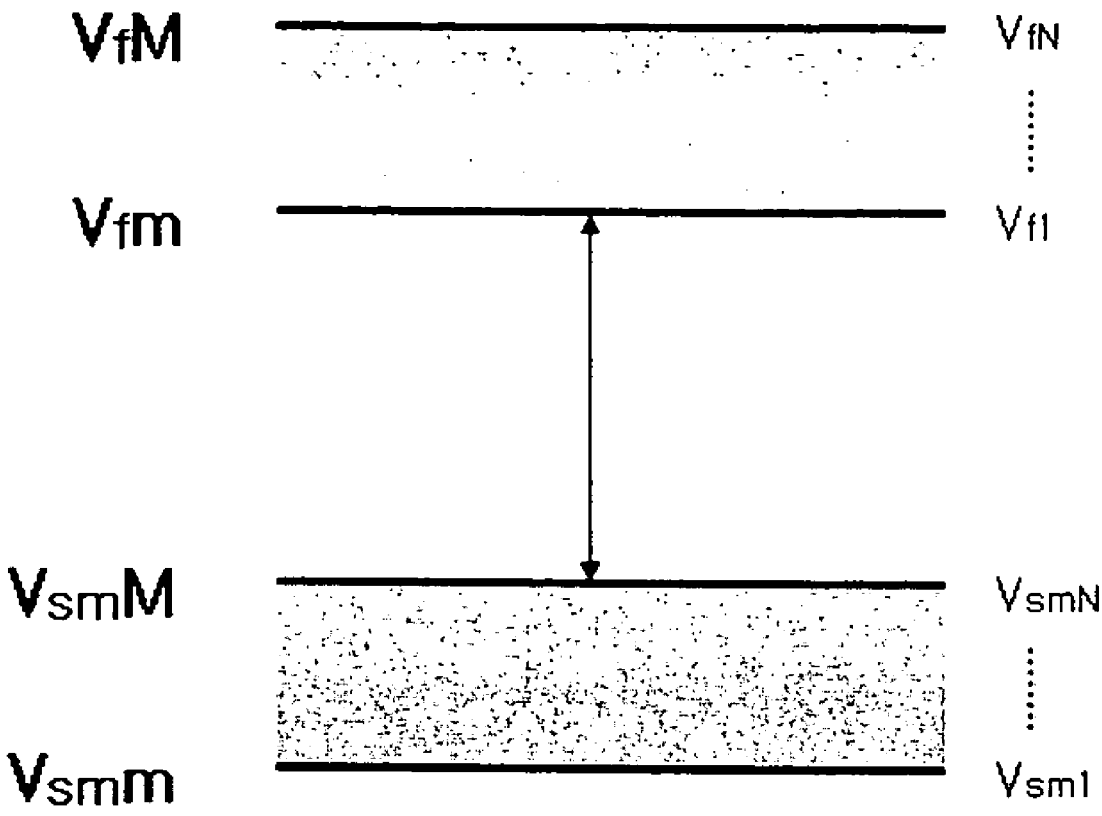
FIG. 12 is a view illustrating voltage ranges of an initiation voltage and a sustain voltage during a memory operation based on the initiation voltage and an erasure voltage.

FIG. 12 is a view illustrating voltage ranges of an initiation voltage and a sustain voltage during a memory operation based on the initiation voltage and an erasure voltage.

A voltage distribution ranges from Vf1 to VfN when each of the discharge cells is changed to the ON status while the sustain voltage Vs is gradually increased in N discharge cells. In this case, a maximum is VfM and a minimum is Vfm. Namely, VfM is a voltage of a discharge cell that is finally changed to ON status while the sustain voltage Vs is gradually increased in N discharge cells, and Vfm is a voltage of a discharge cell that is firstly changed to ON status while the sustain voltage Vs is gradually increased in N discharge cells.

In addition, a voltage distribution ranges from Vsm1 to VsmN when each of the discharge cells is changed to the OFF status while the sustain voltage Vs is gradually decreased in N discharge cells. In this case, a maximum is VsmM and a minimum is Vsmm. Namely, VsmM is a voltage of a discharge cell that is firstly changed to OFF status while the sustain voltage Vs is gradually decreased in N discharge cells, and Vsmm is a voltage of a discharge cell that is finally changed to OFF status while the sustain voltage Vs is gradually decreased in N discharge cells.

In this case, the discharge cell performs the memory operation in which the discharge cell sustains the previous ON status or the previous OFF status when the sustain voltage Vs applied to the discharge cell ranges from Vfm to VsmM. A margin of the static characteristics increases according as a voltage range (Vfm>Vs>VsmM) in which the memory operation occurs increases.

Referring back to FIG. 11, a voltage range in which the memory operation occurs ranges from 260 volts to 50 volts in the conventional plasma display apparatus, however, the voltage range in which the memory operation occurs ranges from about 230 volts to about 340 volts in the plasma display apparatus according to an example embodiment of the present invention when the discharge gap is about 300 μm. Thus, the margin of the static characteristics increases by 60 volts compared with the conventional plasma display apparatus.

The static characteristics are useful for designing driving voltage that enables more stable driving. Namely, a large margin of the static characteristics represents that a voltage range in which stable operation is possible increases.

Figure 13:
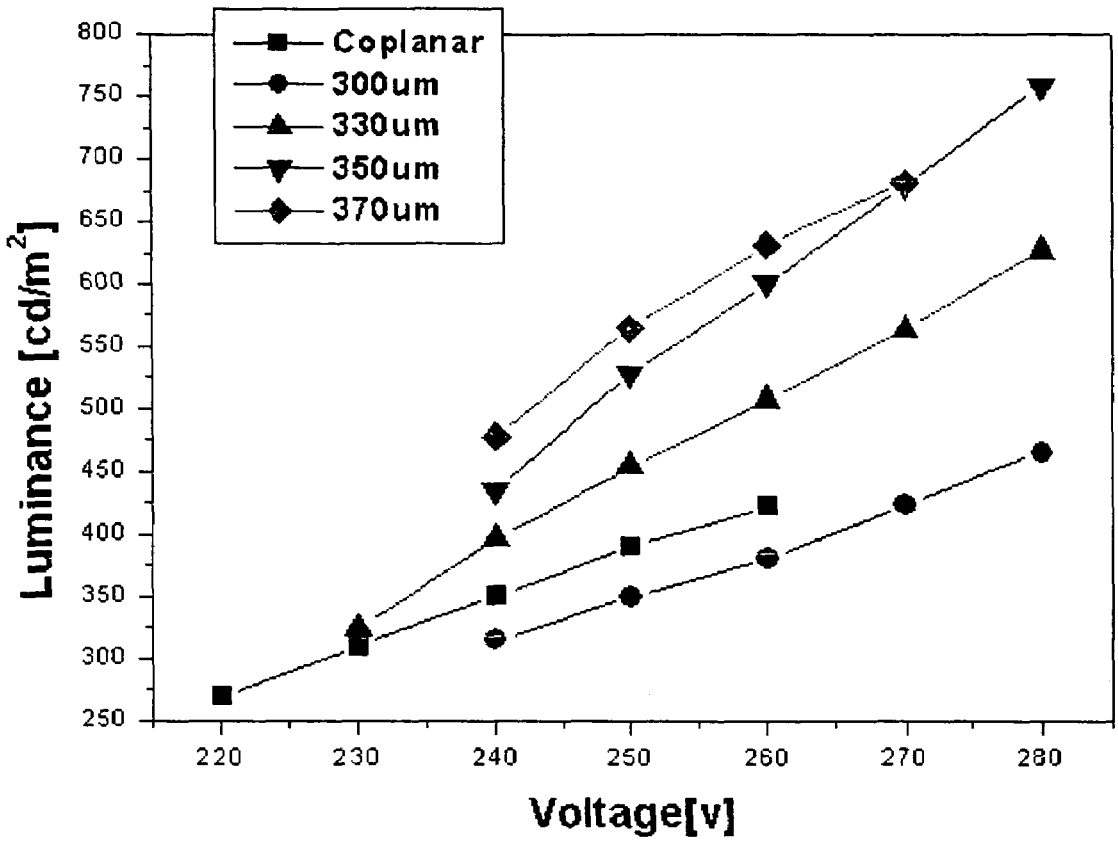
FIG. 13 is a graph illustrating variation of luminance in the plasma display apparatus according to an example embodiment of the present invention.

FIG. 13 is a graph illustrating variation of luminance in the plasma display apparatus according to an example embodiment of the present invention.

Referring to FIG. 13, the luminance of the plasma display apparatus according to an example embodiment of the present invention decreases a little compared with the compared with the conventional plasma display apparatus, of which discharge gap is 300 μm, when the discharge gap is 300 μm. The reason is that the total thickness of the electrode layers is thicker than the thickness of the electrode of the conventional plasma display apparatus, the visible rays generated from sides of the discharge cell is shielded by the electrode layers, and thus the amount of the visible rays transmitted to the front of the plasma display apparatus decreases.

However, the luminance increases according as the discharge gap gradually increases. The increase of the discharge gap represents that the size of the discharge cell increases, and the luminance increases because the area of the phosphor increases when the size of the discharge cell. The ratio of the decreased luminance is about 11% at an operation voltage of about 260 volts even when the discharge gap is 300 μm, however, the decreased luminance dose not cause serious problem compared with the total efficiency of the plasma discharge.

Figure 14:
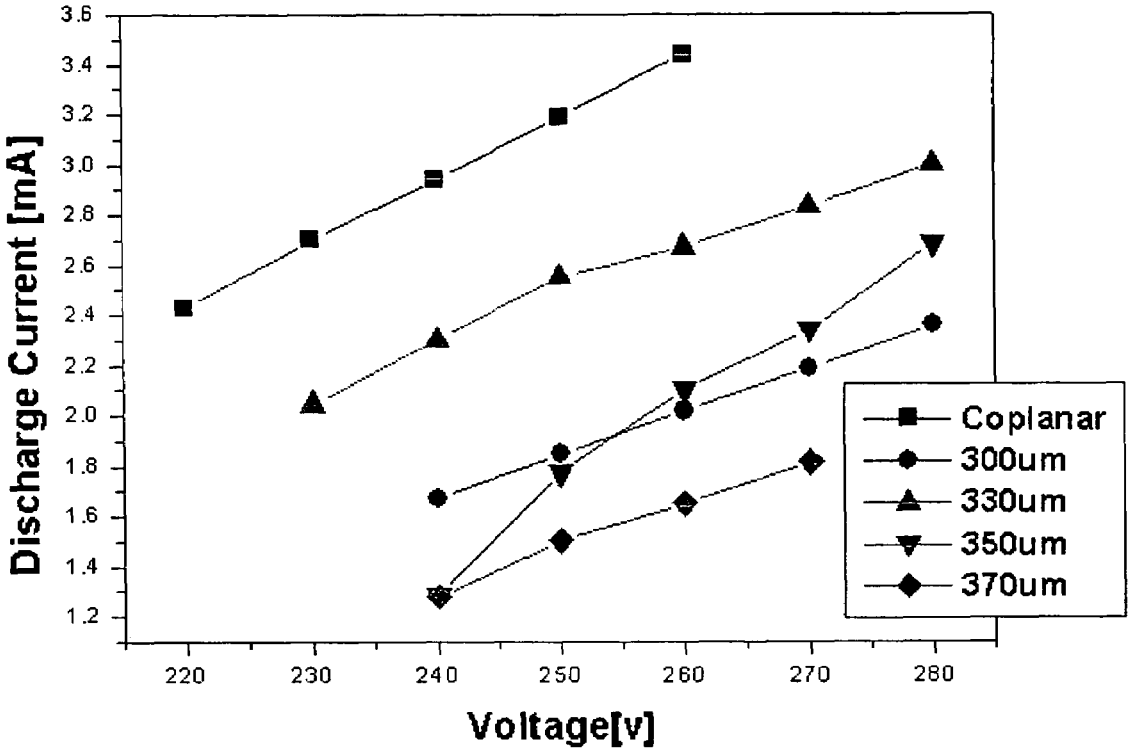
FIG. 14 is a graph illustrating variation of discharge current depending upon a driving voltage in the plasma display apparatus according to an example embodiment of the present invention.

FIG. 14 is a graph illustrating variation of discharge current depending upon a driving voltage in the plasma display apparatus according to an example embodiment of the present invention.

Referring to FIG. 14, a discharge current of the plasma display apparatus having a multi-layer electrode structure according to an example embodiment of the present invention decreases by about 70% compared with the discharge current of the conventional plasma display apparatus when the operation voltage is abut 260 volts and the discharge gap is about 300 μm. Namely, a capacitance of the plasma display panel decreases due to the stacks of the electrodes and the dielectric layers. The plasma loss decreases because the discharge path increases compared with the plasma display apparatus having the surface discharge structure. In addition, the discharge current decreases due to the high excitation efficiency, etc.

The decrease of the discharge current is a big advantage compared with the disadvantage of the decrease of the luminance.

Figure 15:
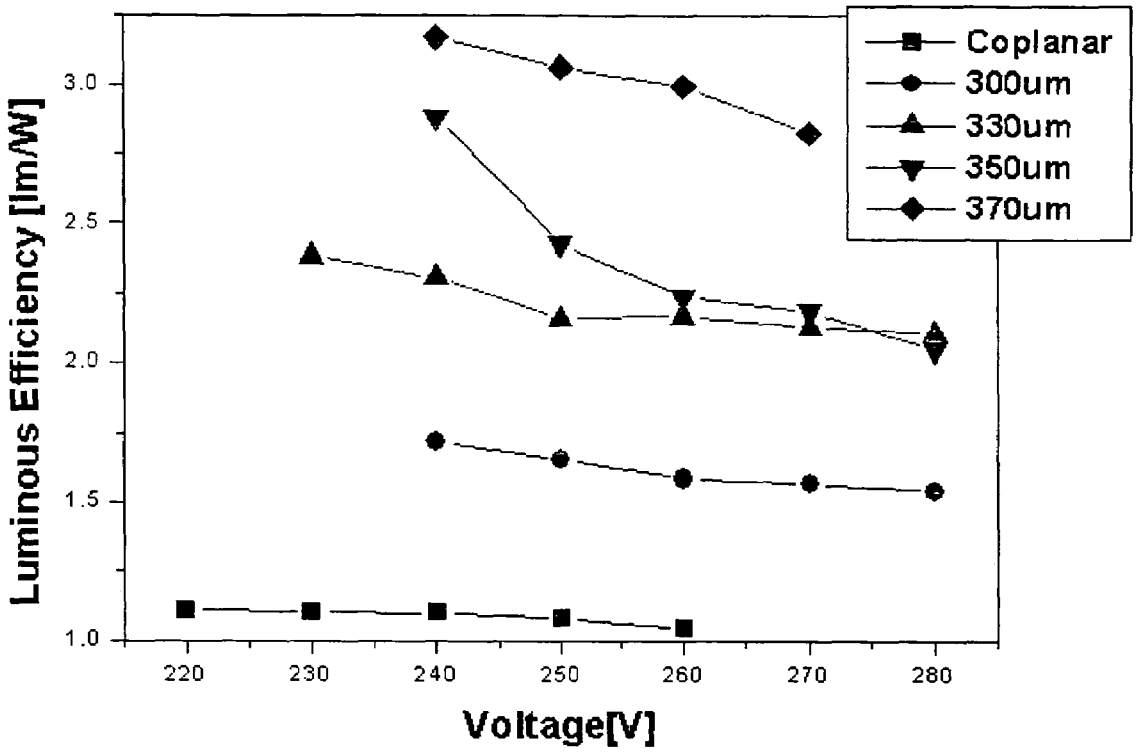
FIG. 15 is a graph illustrating variation of luminous efficiency depending upon a driving voltage in the plasma display apparatus according to an example embodiment of the present invention.

FIG. 15 is a graph illustrating variation of luminous efficiency depending upon a driving voltage in the plasma display apparatus according to an example embodiment of the present invention.

Referring to FIG. 15, the luminous efficiency increases according as the discharge gap increases.

The luminous efficiency increases from 1.02 lm/W to 1.52 lm/W (i.e. by about 67%) when the driving voltage is about 260 volts and the discharge gap is about 300 μm.

Thus, in the plasma display apparatus according to an example embodiment of the present invention, bus electrodes formed on the upper substrate is protruded toward the discharge space, and a discharge occurs between bus electrodes opposite to each other. Thus, although the luminance decreases a little, however, the voltage range in which stable driving is possible increase and the amount of the consumption of the discharge current decreases, to thereby enhancing the luminous efficiency.

In the plasma display apparatus according to an example embodiment of the present invention, a discharge occurs between the bus electrodes opposite to each other and the margin of the static characteristics increases. Thus, the voltage range in which stable driving is possible increase and the amount of the consumption of the discharge current decreases, to thereby reducing power consumption and enhancing the luminous efficiency.

Example embodiment of the present invention being thus described, it will be obvious that the same may be varied in many ways. Such variations are not to be regarded as a departure from the spirit and scope of the invention and all such modifications as would be obvious to one skilled in the art are intended to be included within the scope of the following claims.

What is claimed is:

1. A plasma display apparatus comprising:

a first electrode and a second electrode formed on an upper substrate, the second electrode being arranged in parallel with the first electrode, each of the first and second electrodes including a plurality of electrode layers, each electrode layer of the first electrode including a first sub electrode protruded from a first main electrode in a first direction toward the second electrode, and each electrode layer of the second electrode including a second sub electrode protruded from a second main electrode in a second direction toward the first electrode;

first dielectric layers formed between respective ones of the plurality of electrode layers of the first and second electrodes;

a third electrode formed on a lower substrate opposite to the upper substrate; and a barrier rib formed on the lower substrate to divide a discharge space, wherein the first main electrodes and the first sub electrodes of the first electrode are laminated together in a third direction, and the second main electrodes and the second sub electrodes of the second electrode are laminated together in the third direction, and wherein the third direction protrudes towards the discharge space and the lower substrate.

2. The plasma display apparatus as claimed in claim 1, wherein the discharge space is formed between the first and second sub electrodes.

3. The plasma display apparatus as claimed in claim 1, wherein the main electrodes and the sub electrodes of the first and second electrodes are comprised of a metal.

4. The plasma display apparatus as claimed in claim 3, wherein the main electrodes of the first and second electrodes are comprised of a first metal, the sub electrodes of the first and second electrodes are comprised of a second metal different from the first metal.

5. The plasma display apparatus as claimed in claim 1, wherein each of the electrode layers of the first and second electrodes has a thickness of about 10 μm.

6. The plasma display apparatus as claimed in claim 1, wherein a thickness of each of the first dielectric layers is substantially the same as a thickness of a main electrode layer or a sub electrode layer.

7. The plasma display apparatus as claimed in claim 6, wherein dielectric constants of the first dielectric layers are different from each other.

8. The plasma display apparatus as claimed in claim 1, further comprising second dielectric layers having a predetermined thickness, wherein each of the second dielectric layers covers the electrode layers of a different one of the first and second electrodes.

9. The plasma display apparatus as claimed in claim 8, further comprising third dielectric layers, wherein each of the third dielectric layers is formed between the upper substrate and a top electrode layer of a different one of the first and second electrodes.

10. The plasma display apparatus as claimed in claim 9, wherein a thickness of each of the third dielectric layers is substantially the same as a thickness of a main electrode layer or a sub electrode layer.

11. A plasma display apparatus comprising:

a first electrode and a second electrode formed on an upper substrate, the second electrode being arranged in parallel with the first electrode;

a third electrode formed on a lower substrate opposite to the upper substrate;

a barrier rib formed on the lower substrate to divide a discharge space, and wherein each of the first electrode and the second electrode includes a plurality of electrode layers that are respectively laminated in a direction that protrudes toward the discharge space and lower substrate, and wherein each of the electrode layers of the first and second electrodes includes a sub electrode that protrudes from and is at least substantially coplanar with a main electrode and first dielectric layers formed between the electrode layers of respective ones of the first and second electrodes.

12. The plasma display apparatus as claimed in claim 11, wherein the discharge space is formed between the first and second electrodes.

13. The plasma display apparatus as claimed in claim 11, wherein the first and second electrodes are comprised of a metal.

14. The plasma display apparatus as claimed in claim 11, wherein the at least two electrode layers have a thickness of about 50 μm.

15. The plasma display apparatus as claimed in claim 11, wherein a thickness of each of the first dielectric layers is substantially the same as a thickness of a first electrode layer of the first electrode or a thickness of a second electrode layer of the second electrode.

16. The plasma display apparatus as claimed in claim 11, further comprising second dielectric layers having a predetermined thickness, wherein each of the second dielectric layers covers the electrode layers a different one of the first electrode or the second electrode.

17. The plasma display apparatus as claimed in claim 16, further comprising third dielectric layers, wherein each of the third dielectric layers is formed between the upper substrate and a top electrode layer of a different one of the first and second electrodes.

18. A plasma display apparatus comprising:

a first electrode and a second electrode formed on an upper substrate, the second electrode being arranged in parallel with the first electrode, wherein each of the first and second electrodes includes a plurality of electrode layers having substantially a same width laminated together and protruding in a direction towards a discharge space and a lower substrate opposite to the upper substrate; and a first dielectric layer having a predetermined thickness, the first dielectric layer covering the first and second electrode layers, and one or more second dielectric layers formed between respective ones of the plurality of electrode layers of the first and second electrodes.

* * * * *